United States Patent [19]

Vedder

[11] Patent Number: 4,739,996

[45] Date of Patent: Apr. 26, 1988

[54] TARGET WITH AUTOMATIC RESET MEANS

[76] Inventor: John A. Vedder, 800 S. Meade Ave., Fullerton, Calif. 92633

[21] Appl. No.: 905,522

[22] Filed: Sep. 10, 1986

[51] Int. Cl.[4] ..... F41J 7/04

[52] U.S. Cl. ..... 273/392

[58] Field of Search ..... 273/391, 392

[56] References Cited

U.S. PATENT DOCUMENTS 4,426,085 1/1984 Dixon ..... 273/392

FOREIGN PATENT DOCUMENTS 443659 10/1927 Fed. Rep. of Germany ..... 273/392

*Primary Examiner*—Anton O. Oechsle

*Attorney, Agent, or Firm*—Harlan P. Huebner

[57] ABSTRACT

Target and automatic reset apparatus which includes a reuseable target for use with firearms that includes motor and clutch means associated with the target that upon the target being struck and pivoting from the vertical will raise the same back to the vertical for reuse. There are trip means associated with the target means to cause clutch engagement and chain means linking the clutch means and target means to effect reelevation of the target means. The apparatus may be self contained with batteries therein to activate the motor.

8 Claims, 3 Drawing Sheets

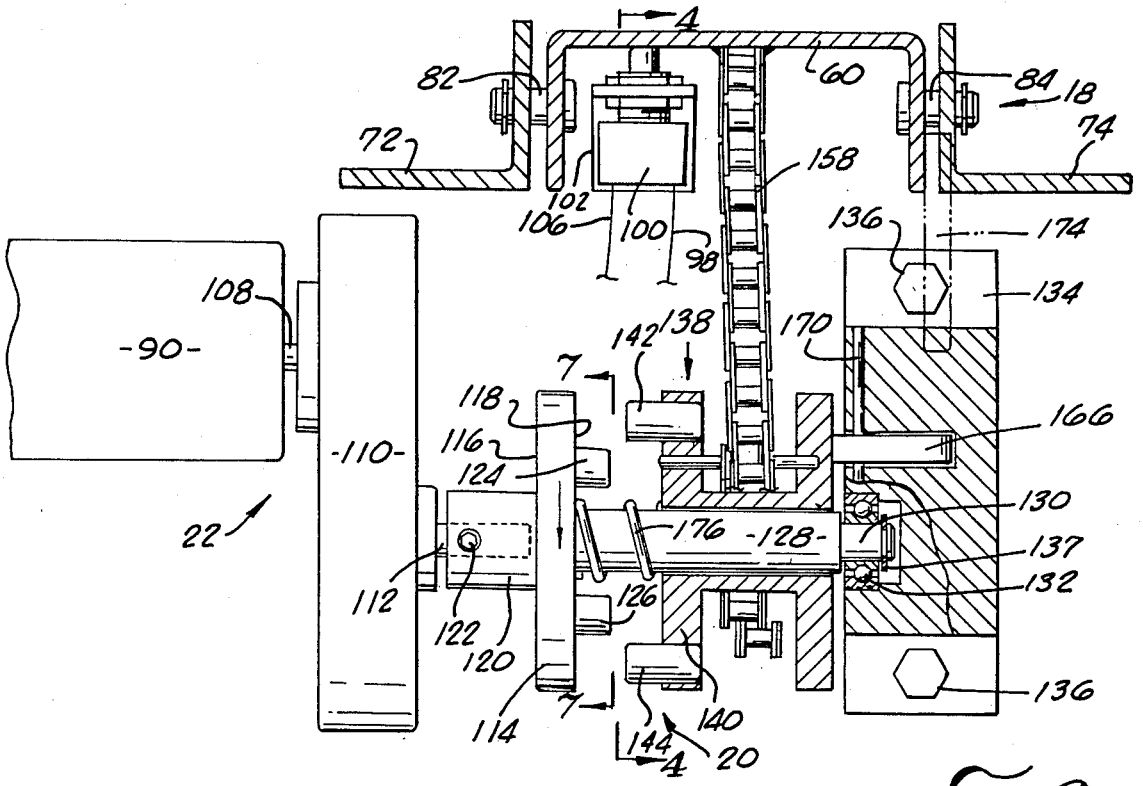
FIG. 3.
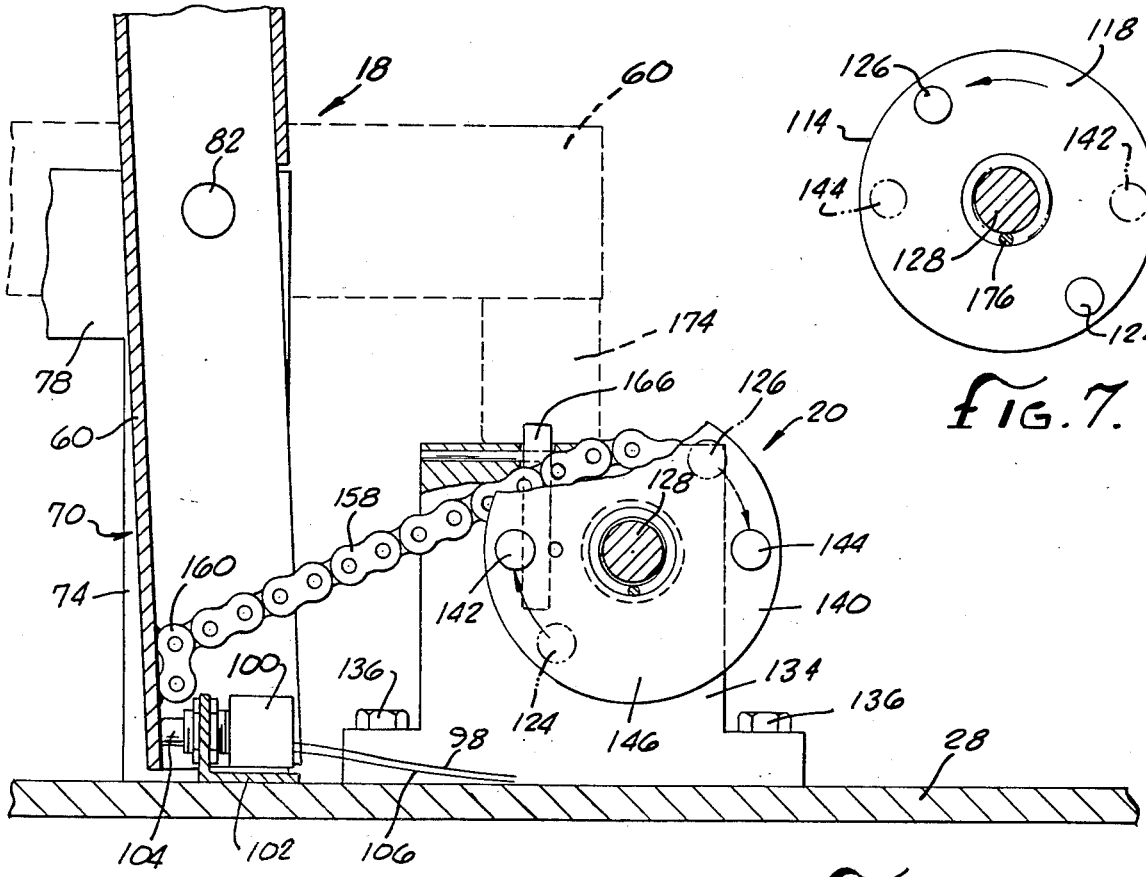
FIG. 4.
FIG. 7.

TARGET WITH AUTOMATIC RESET MEANS

BACKGROUND OF THE INVENTION

1. Field of the Invention.

This invention relates to a target that when knocked down includes means that will automatically raise the target and reset the same for further target use.

2. Description of the Prior Art

In rifle or pistol target shooting it is always a problem as to replacing the target when hit by a bullet.

The replacement of targets is usually necessary when the targets are paper so that it can be determined if the next shooter has hit the target. This means that someone must walk out to the target in order to replace the same.

In addition, if metallic targets, such as silhouette targets, are used they are usually on relatively small bases so that when they are hit by a bullet they will fall over, designating a hit. In each instance the target must be manually raised and righted to prepare the same for additional use. This is a time consuming effort to travel to the spot, right the target, and return.

The manual movement to and from the target by the target setter can also be extremely dangerous, particularly where there are others using nearby target ranges and shots may go wild.

In addition, in the case of a shooting course where there are a plurality of targets along the course, time must be spent in moving to each individual target and resetting the same. This in turn holds up those using the shooting course.

SUMMARY OF THE INVENTION

It is the purpose of the present invention to provide shooting target which is pivotally mounted in a base, and when knocked down by a bullet the same will automatically be pivoted to a reset position for reuse.

An object of the present invention is to provide a target that is made of metal and is reusable and will automatically reset itself.

Another object is to provide a self contained unit of a target, base and reset means that are automatically activatable to right the target.

A further object is to provide a motor and drive means coupled to a reusable target which are automatically activatable by the target as it pivots down upon being hit by a bullet.

A still further object is to provide means engagable by the target to activate the motor means and additional means to turn the motor off when the target is righted.

A further object is to provide a motor means to assist in pivoting the target which is battery operated for use in areas where no electricity is available.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which:

FIG. 3 is a cross-sectional view of the automatic resetting means taken on lines 3—3 of FIG. 2;

FIG. 4 is a cross-sectional view taken on lines 4—4 of FIG. 3;

FIG. 7 is a front face view of a portion of the clutch means taken on lines 7—7 of FIG. 3.

DETAILED DESCRIPTION OF THE PREFERRED EMBODIMENT

Figure 1:
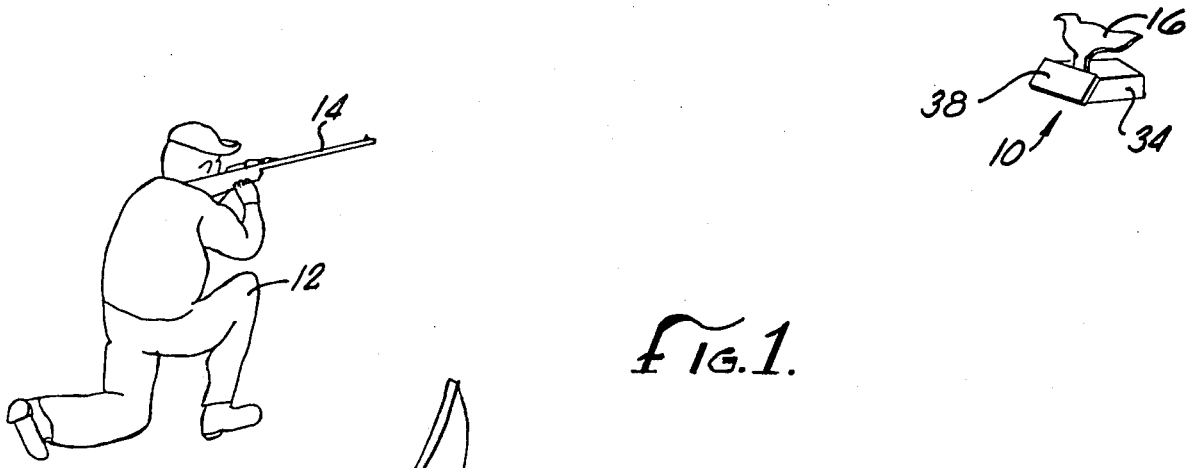
FIG. 1 is an environmental view of the target of the present invention and a target shooter.
Figure 2:
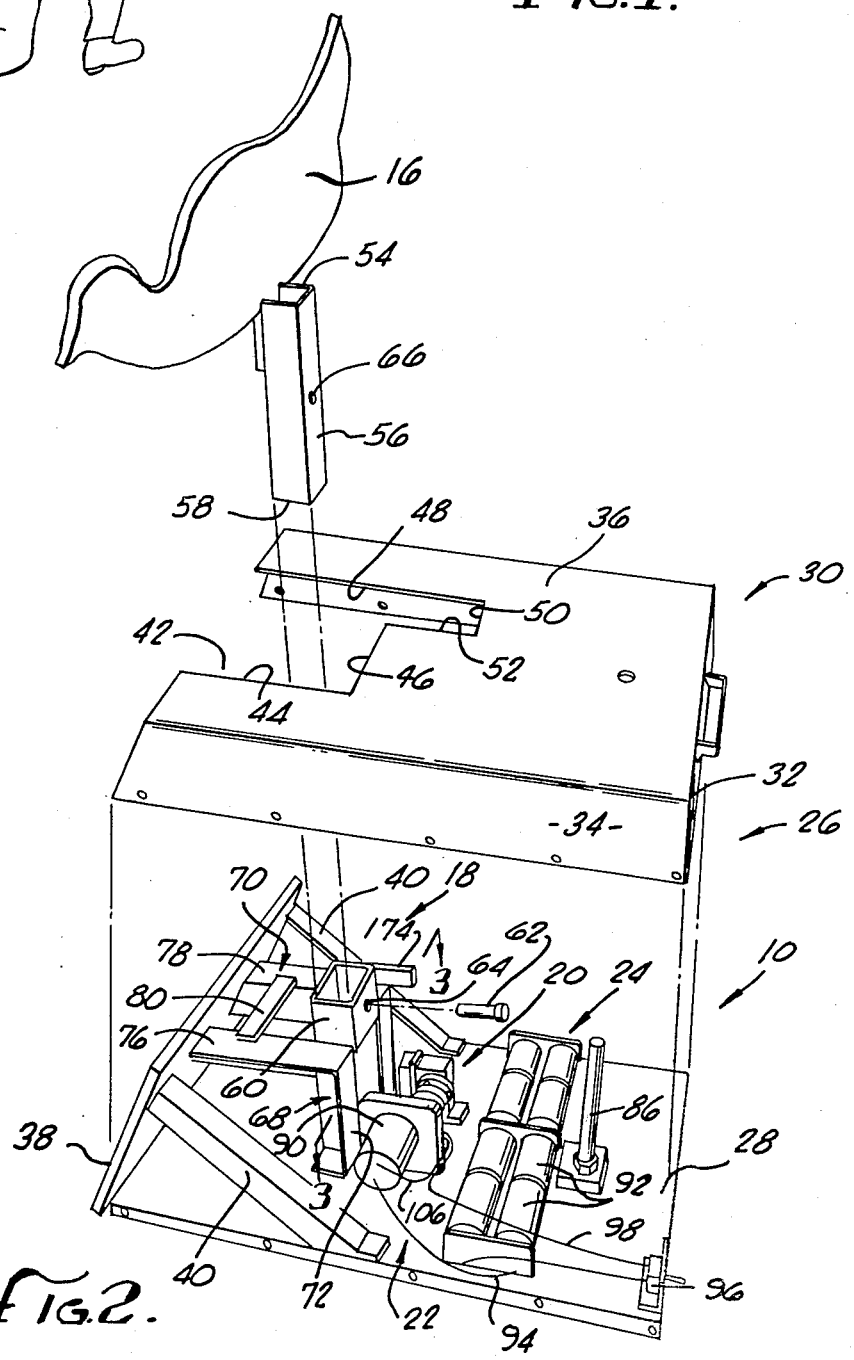
FIG. 2 is perspective view of the target device with automatic resetting means.
Figure 5:
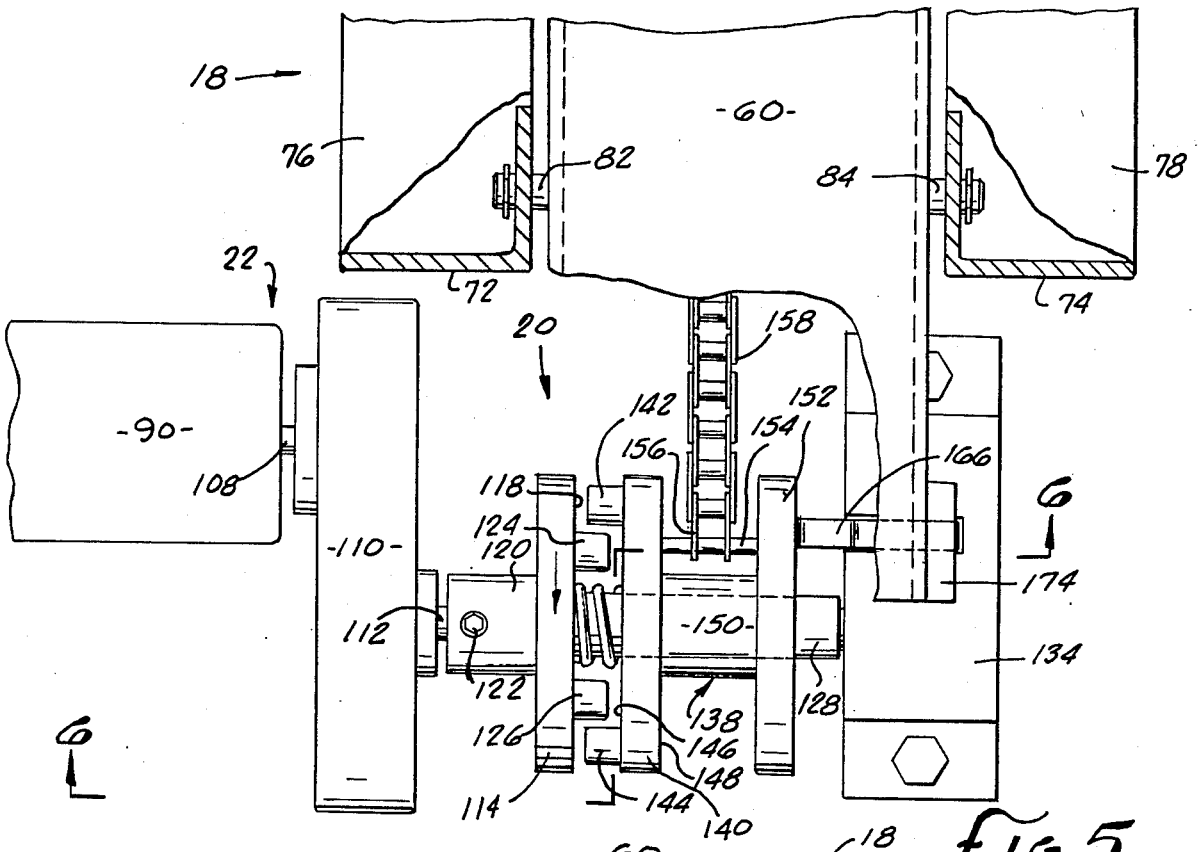
FIG. 5 is a top view similar to FIG. 3 of the resetting means in engagement.

FIGS. 1 and 2 illustrate the target and automatic reset apparatus generally designated 10. As can be seen in FIG. 1 the apparatus 10 is placed on the ground at any desired distance from a target shooter 12 who will be target shooting with a rifle 14 or pistol (not shown). The apparatus 10 may be positioned and used on a target range with a fixed position for the shooter 12 or several apparatuses 10 may be placed along a walking type of target course.

The actual target 16 is preferably a silhouette of game or birds and if the target 16 is to be used for pistols or hand guns it has been found that the target may be cut from ⅜" steel plate. In the case of rifle targets 16 the steel plate is preferably 2" to 2¼" thick. With targets of that thickness bullets will knock over the target 16 but will not destroy the target.

The target 16 is mounted upon pivot means generally designated 18 which in turn is linked with clutch means 20 associated with motor-gear means 22 which is powered by power means designated 24. All of the means 18, 20, 22, and 24 are preferably mounted in a housing designated 26 with bottom 28 and cover 30. The cover 30 includes rear wall 32, side walls 34 and top 36. An angled front wall 38 is secured to bottom 23 by welding or other means. Also a pair of support struts 40 extend from the angled front wall 38 to the bottom 28. The wall 38, preferably of heavy steel plate is angled upwardly to deflect bullets that miss the target 16, thus protecting the internal mechanism of the apparatus 10.

The top 36 is provided with a cut out 42 formed by edges 44, 46, and 48 and projecting inwardly of edge 46 may be smaller elongated cut off formed by edge 48, end edge 50 and a side edge 52 generally parallel with edge 48.

The target 16 is mounted by conventional means at the end 54 of a pivot bar 56 which may be formed of channel iron. The bar 56, forming a part of pivot means 18, has a lower end 58 which interfits within a pivot bar receiving cup 60. A bolt 62, FIG. 2, passes into cup 60 and bar 56 through respective holes 64 and 66 to lock the target in the cup 60.

The pivot bar 56 extends upward through the cut out 42 so the target 16 is above the cover 36.

The cup 60 is pivotally mounted between a pair of pivot support frames 68 and 70. The frames 68 and 70 may be of angle iron stock that include vertical legs 72 and 74 secured to bottom 28, see FIG. 2 and 6, and horizontal legs 76 and 78 having ends secured to the front wall 38. A support bracket 80 may be employed between horizontal legs 76 and 78.

Figure 6:
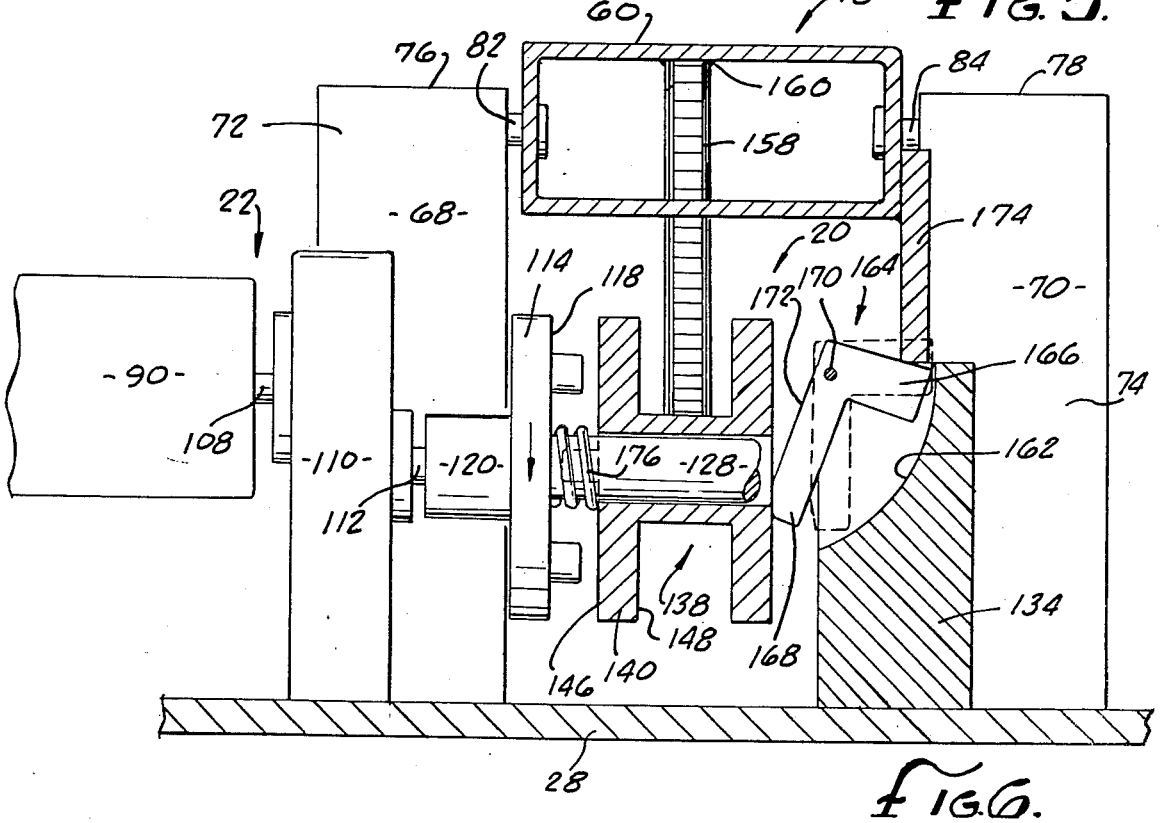
FIG. 6 is an elevational cross-sectional view of clutch means including the clutch engaging means taken on lines 6—6 of FIG. 5.

In order to maintain the cup 60 in a pivotal relationship, pivot pins 82 and 84 pass between the sides of the cup and the vertical legs 72 and 74, see FIGS. 4, 6, and 7. This will allow the cup 60, pivot bar 56 and target 16 to pivot from the vertical, see FIG. 4, where the bar 56 is actually slightly offset so it will tip forward over center to a near horizontal position, dashed lines FIG. 4.

A stop pin 86 is secured to the bottom 28 extending upwardly and will stop the target 16 from falling below horizontal when the same has been hit by a bullet.

In order to automatically elevate or right the target 16 to a vertical position motor-gearing means 22 and clutch means 20 are provided. The motor-gearing means includes preferably a conventional electric motor 90 which is powered by a battery or batteries 92 mounted on the bottom 28. A lead wire 94 extends from the batteries 92 to the motor 90. Another lead wire extends to a safety on-off toggle switch 96, see FIG. 2, with another wire 98 leading to a push button switch 100. When the apparatus 10 is not in use the switch 96 will be placed in an off position, see FIG. 4.

The conventional push button switch 100 includes a mounting bracket 102 secured to bottom 28. As can be seen, the plunger 104 of the switch 102 is contacted by the cup 60 when the target 16 is in its upward position ready for use. In this position the circuit is broken and the motor 90 is not activated. There is a lead wire 106 extending from the push button switch to the motor 90.

When the target 16 is hit by a bullet it will pivot as well as the bar 56 and cup 60 from the vertical to a generally horizontal position.

As the cup 60 pivots the plunger 104 of the switch 102 is allowed to move forward closing the circuit and the motor 90 is actuated. In turn the shaft 108 extending to a reduction gear box 110 will rotate, in turn rotating the reduced gear shaft 112.

Mounted on the shaft 112 is the clutch means 20 which includes a rotatable first annular clutch plate 114 having an outside surface 116 and inside surface 118 with a hub 120 projecting from surface 116 and set screw 122 locks the same on the shaft 112.

Projecting from inner face 120 are a pair of friction locking pins 124 and 126, see FIG. 7, which are diametrically mounted thereon.

Also projecting from the clutch plate 114 is an enlarged clutch shaft 128 that terminates in a reduced end 130 seated in a bearing 132 that is in turn mounted in a bearing housing 134 held to the bottom 28 by bolts 136. A snap ring 136 holds the shaft 128 in the bearing 132.

Slidably mounted on the clutch shaft 128 is a freely rotatable second annular clutch plate and pulley means 138. This means 138 includes a second clutch plate 140 comparable to plate 114 with a pair of diametrically spaced friction locking pins 142 and 144 extending from inside surface 146 of the plate 140. The outside surface 148 of plate 140 includes a hub 150 around shaft 128. The hub 150 terminates in an outer plate 152. The plates 140 and 152 and hub 150 form a spool.

Extending between the plates 140 and 152 is a chain holding pin 154. The pin 154 receives one end 156 of a tie means or chain 158 such as a sprocket chain. The other end 160 of the chain 158 is welded or otherwise secured to the cup 60, see FIG. 4.

Mounted within the bearing housing 134 in a recess 162 is a clutch engaging means or rocker arm 164 which is an inverted L with a top leg 166 and clutch engaging leg 168 depending from the leg 166. The arm includes a pivot pin 170, see FIG. 6. Also the leg 168 includes a clutch engaging surface 172.

The clutch engaging rocker arm 164 is activated (pivoted) by a trip arm 174 which is welded or otherwise secured to the cup 60, see FIG. 6.

In operation, the target 16 is usually in a ready position or upright, slightly forward position as seen in FIG. 2.

When it is desired to make the apparatus functional the on-off switch 96 is turned on to activate the system.

When the target 16 is hit and knocked over by a bullet the target, pivot bar 56 and cup 60 will pivot rearwardly. As the cup 60 moves from the position of FIG. 4 where trip arm 174 is horizontal to a near horizontal position the arm 174 moves vertically and engages the rocker arm 164, see FIG. 6.

Also as the pivoting commences the pushbutton switch 100 is released which had be held in an open position with the cup 60 bearing against the switch 100. This will activate the motor 90 and in turn rotate the first clutch plate 114. As the target 16 pivots the second clutch plate 140 is free to rotate and the chain 158 can be pulled off of the pulley.

When the rocker arm 164 is engaged it pivots outwardly with clutch engaging surface 172 contacting the outer plate 152. This in turn will push the second plate and pulley assembly 138 along the shaft 128 as the assembly 138 is loosely seated around the shaft 128.

As the assembly 138 moves toward the rotating first clutch plate 114 the friction locking pins 124, 126, 142, and 144 will engage, see FIG. 7 and the rotation of the first clutch plate 114 will be imparted to the second clutch plate 140.

As the plate 140 and pulley means rotates the chain 158 will be wound on the hub 150 which will pull the cup 60, bar 56 and target 16 from the horizontal to the vertical.

When the cup 60 is again vertical the switch 100 is contacted and the circuit is opened turning off the motor 90. When the motor stops, spring 176 will urge the plates apart as seen in FIG. 3. In this position the assembly is ready for reuse.

The invention and its attendant advantages will be understood from the foregoing description and it will be apparent that various changes may be made in the form, construction, and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. Target and automatic reset apparatus comprising:

a housing;

a pivot frame mounted in said housing;

a pivot bar pivotally mounted on said pivot frame and adopted to be moved between generally vertical and horizontal positions, which when in a vertical position is slightly off center to the true vertical so that when said pivot bar is vertical said pivot bar will be slightly offset from the vertical to assure a ready position which is not easily moved, said pivot bar when pivoted to a vertical position extends upwardly and outwardly of said housing;

a target mounted on said pivot bar exteriorly of said housing, motor and gearing means within said housing to move said pivot bar between said horizontal and said vertical positions wherein said gear means is connected to said motor and said pivot bar;

power means connected to said motor means;

a bearing housing mounted in said housing;

clutch means associated with said motor and gearing means including a clutch shaft projecting from said gearing means and having an outer end journaled in said bearing housing, said means united with said pivot bar whereby said motor and gearing means and said clutch means are activatable when said pivot bar moves to the generally horizontal position to raise said pivot bar and said target to said generally vertical reuse position; and clutch engaging means activatable by said pivot bar.

2. Target and automatic reset apparatus as defined in claim 1 wherein there are switch means to control said power means to said motor and said switch means when engagable by said pivot means in said vertical position to maintain said switch in an open position but upon disengagement from said pivot bar will close and cause power to pass and activate said motor.

3. Target and automatic reset apparatus as defined in claim 1 wherein said pivot bar includes a pivot cup and said pivot bar is removably mounted therein whereby said targets may be exchanged.

4. Target and automatic reset apparatus comprising;

a housing;

pivot means within said housing, said pivot means adopted to receive a target, said pivot means preferably maintained in a generally vertical ready position with said target outside of said housing, and said pivot means yieldable from said generally vertical ready position to a generally horizontal position when said target is hit by a bullet;

motor and gearing means within said housing to move said pivot means from said generally horizontal position to said generally vertical ready means wherein said gearing means is connected to said motor and said pivot means;

power means connected to said motor means;

a bearing housing mounted in said housing;

a first clutch plate fixedly mounted on said clutch shaft for rotation, said plate including at least one friction locking pin;

a second clutch plate and pulley means freely mounted on said shaft and capable of horizontal sliding movement on said shaft, said means including at least one friction locking pin facing said friction locking pin of said first plate and each of said pins adopted to engage each other upon horizontal shifting of said second clutch plate and pulley means toward said first clutch plate whereby rotation will be imparted to said second clutch plate;

tie means extending from said pivot means to said pulley means and adapted to be wrapped around said pulley means when it is rotated to move said pivot means from said generally horizontal to said vertical position for reuse; and clutch engaging means activatable by said pivot means.

5. Target and automatic reset means as defined in claim 4 wherein said clutch engaging means includes:

a rocker arm pivotally mounted in said bearing housing which includes a portion that can move into and out of said bearing housing and engage said second plate means; and a trip arm associated with said pivot means adopted to engage said rocker arm to move the same out of said bearing housing to contact and slidable shift said second clutch plate into contact with said first clutch plate.

6. Target and automatic reset means as defined in claim 5 wherein said clutch means includes:

a spring between said first and second clutch plate to urge said second clutch plate and pulley means away from said first clutch plate once said trip arm shifts back into said bearing housing.

7. Target and automatic reset means as defined in claim 4 wherein said tie means is a sprocket chain.

8. Target and automatic reset means as defined in claim 4 wherein each clutch plate includes a pair of diametrically opposed friction locking pins for engagement to impart rotation to said second clutch plate.

* * * * *